US010151154B2

(12) United States Patent
Quintana et al.

(10) Patent No.: US 10,151,154 B2
(45) Date of Patent: Dec. 11, 2018

(54) FLEXIBLE TOOL HOUSING

(71) Applicant: Halliburton Energy Services, Inc., Houston, TX (US)

(72) Inventors: Luis Enrique Quintana, Jette (BE); Alexis Chris Van Lysebeth, Brussels (BE); Olivier Christophe Roche, Schaerbeek (BE)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/119,481

(22) PCT Filed: Apr. 8, 2014

(86) PCT No.: PCT/US2014/033288

§ 371 (c)(1),
(2) Date: Aug. 17, 2016

(87) PCT Pub. No.: WO2015/156772

PCT Pub. Date: Oct. 15, 2015

(65) Prior Publication Data

US 2017/0022769 A1 Jan. 26, 2017

(51) Int. Cl.

| | |
|---|---|
| ***E21B 17/20*** | (2006.01) |
| ***E21B 7/04*** | (2006.01) |
| *E21B 10/32* | (2006.01) |
| *E21B 17/00* | (2006.01) |

(52) U.S. Cl.
CPC ..... *E21B 17/20* (2013.01); *E21B 7/04* (2013.01); *E21B 10/32* (2013.01); *E21B 17/00* (2013.01)

(58) Field of Classification Search
CPC ..... E21B 17/20; E21B 10/32
See application file for complete search history.

(56) References Cited

U.S. PATENT DOCUMENTS

| | | | |
|---|---|---|---|
| 4,147,185 | A | 4/1979 | Hines |
| 6,409,226 | B1 | 6/2002 | Slack et al. |
| 7,383,897 | B2 | 6/2008 | Moody et al. |
| 2008/0035328 | A1 | 2/2008 | Hill et al. |
| 2009/0133936 | A1 | 5/2009 | Hall et al. |
| 2011/0067925 | A1 | 3/2011 | Underwood et al. |

(Continued)

FOREIGN PATENT DOCUMENTS

| | | |
|---|---|---|
| CN | 202832276 | 3/2013 |
| CN | 103299021 | 9/2013 |
| JP | 60253694 | 12/1985 |

OTHER PUBLICATIONS

"International Application Serial No. PCT/US2014/033288, International Search Report dated Jan. 27, 2015", 3 pgs.

(Continued)

*Primary Examiner* — Giovanna C. Wright
*Assistant Examiner* — Kristyn A Hall
(74) *Attorney, Agent, or Firm* — Chamberlain Hrdlicka

(57) ABSTRACT

A flexible reamer housing includes a tubular central portion including a tool bay with an aperture to allow a reamer cutter arm within the tool bay to move radially outward through the aperture, and tubular first and second auxiliary portions arranged toward opposite ends of the central portion. The first and second auxiliary portions each include a first stiffness that is less than a second stiffness of the central portion.

25 Claims, 5 Drawing Sheets

(56) References Cited

U.S. PATENT DOCUMENTS

| | | | | |
|---|---|---|---|---|
| 2011/0308858 | A1 | 12/2011 | Menger et al. | |
| 2011/0308861 | A1 | 12/2011 | Radford | |
| 2012/0073879 | A1* | 3/2012 | Makkar | E21B 10/322 175/406 |
| 2012/0261017 | A1* | 10/2012 | Christensen | F16L 11/10 138/137 |
| 2013/0098687 | A1 | 4/2013 | Hashem et al. | |

OTHER PUBLICATIONS

"International Application Serial No. PCT/US2014/033288, Written Opinion dated Jan. 27, 2015", 9 pgs.

* cited by examiner

FLEXIBLE TOOL HOUSING

RELATED APPLICATIONS

This application is a U.S. National Stage Filing under 35 U.S.C. 371 of International Patent Application Serial No. PCT/US2014/033288, filed Apr. 8, 2014, and published on Oct. 15, 2015 as WO 2015/156772A1, each of which is incorporated by reference herein in its entirety.

BACKGROUND

This disclosure relates to methods and apparatus for use in forming subterranean boreholes, and more specifically to tools that bend or flex within such boreholes. Directional or steerable drilling tools can be employed to drill boreholes that deflect the bit path by some degree from an existing path into a subterranean formation, by imposing one or more (typically multiple) radii into the borehole path. In some cases, these radii will be difficult for other tools in the tool string, or in another tool string, to traverse.

Drilling systems that deploy a tool string in a non-linear borehole need segments of the string capable of navigating the non-linear portions of the borehole. As such, these tool string segments may be required to bend or otherwise conform to the radius or curved portion of the borehole. In some cases, the tool string segments are configured to bend to navigate the curved portions of the borehole. To achieve maximum deflection, such bending tool string segments are commonly configured to bend across their entire length, which generally may place the maximum stress at the central most region of the segment.

DETAILED DESCRIPTION

Figure 1:
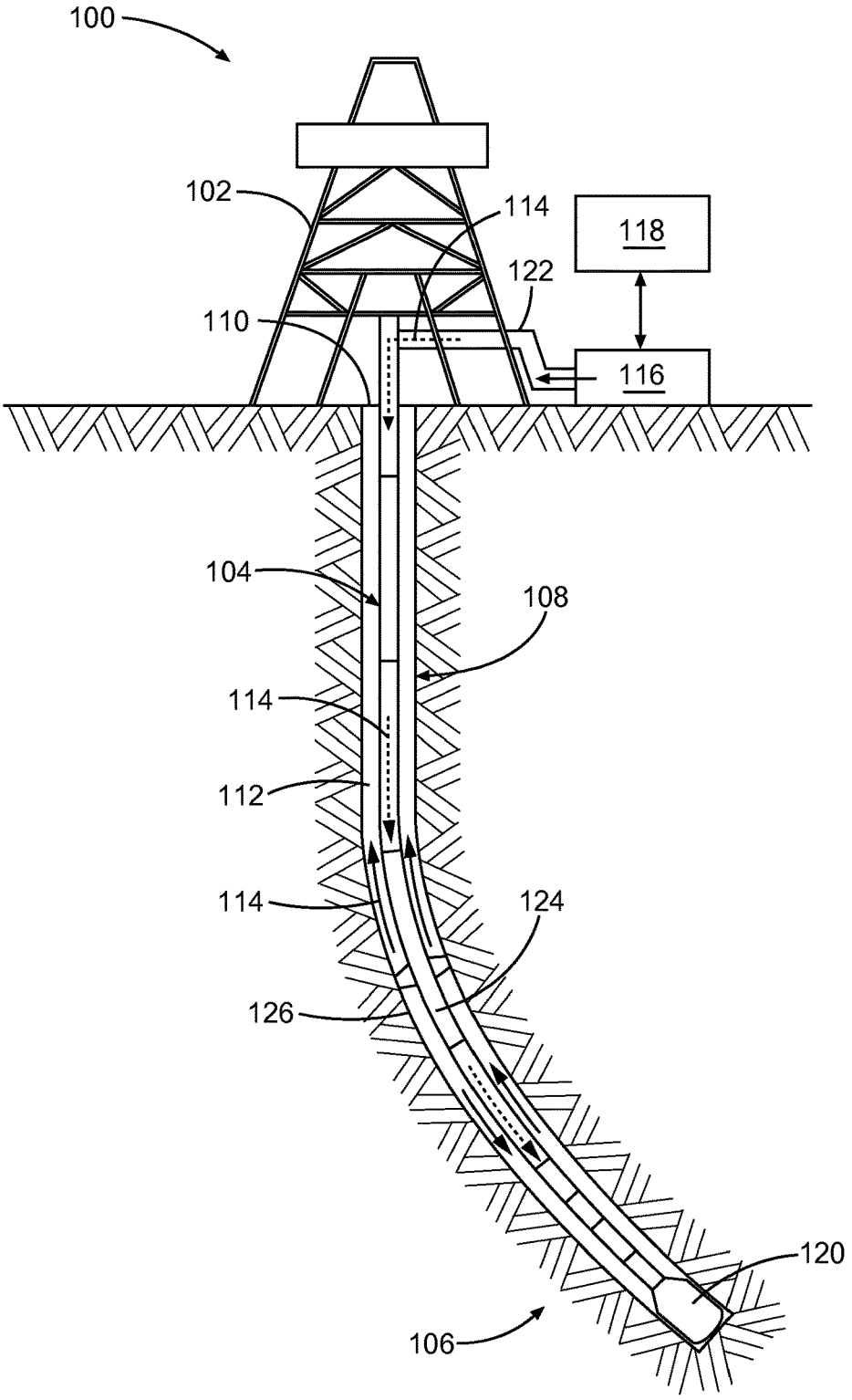
FIG. 1 schematically depicts an example directional drilling system.

Examples according to this disclosure are directed to a tubular tool housing configured to bend under a load within a non-linear (i.e, radiused) portion of a borehole to traverse the radiused portion. The housing is configured to flex by varying the construction of the housing along the longitudinal axis such that different portions of the housing have different stiffnesses. For example, the housing can include a first portion with a first stiffness that is different than a second stiffness of a second portion of the housing. The variable stiffness housing can be configured to retain strength in some axial regions, while allowing the housing to bend when navigating non-linear portions of a deviated borehole.

The stiffness of a tool housing at a particular axial location can be a function of at least the material composition and the cross-sectional geometry of the housing at the location. For example, the stiffness of a tubular housing can be varied along the longitudinal axis by changing the material stiffness and/or changing the diameter and/or wall thickness of the housing at different axial locations. The stiffness of the housing can also be varied along the longitudinal axis by changing the arrangement, for example, by changing the radial arrangement of the different materials (with different material stiffness values) from which the housing is constructed.

The "stiffness" of a tool housing can, in some examples, refer to the resistance of the housing to a bending moment applied at a particular location along the longitudinal axis of the housing versus, for example, the "material stiffness" of a material, which refers to an inherent property of the material. As such, in some examples, a flexible tool housing includes different axially arranged portions exhibiting different bending stiffness values under a bending moment applied at different locations along the longitudinal axis of the housing. The manner by which the variable bending stiffness of the housing is achieved includes, in some examples, varying the material and thus the material stiffness along the longitudinal axis of the housing.

As noted above, directional drilling systems are employed to drill boreholes that deviate from the current borehole path into a subterranean formation. Tools or tool string segments in such installations are sometimes required to bend or flex to navigate curved, non-linear portions of the boreholes. One design objective of drilling subs in directional drilling systems is achieving a target degree of deflection, which parameter is often referred to as dogleg capability.

Some tools include a structure or mechanism located at a relatively central portion of the length of the tool housing which requires increased rigidity proximate such central portion. Examples of such tools include reamers, which include one or more arms selectively deployable from a radially collapsed to a radially expanded state. In such reamers, the tool housing may include one or more circumferentially arranged apertures through which the expanding and contracting arm and/or arm control mechanism passes when be activated and deactivated. When the reamer arms are radially expanded, the supporting structure of the tool housing may need to be configured to provide sufficient rigidity to support the extended arms, and the actuating mechanism for controlling the arms, during a reaming operation.

Examples according to this disclosure are directed to flexible drilling tool housings that are fabricated from material(s) with material stiffness values and/or cross-sectional geometry that varies along the longitudinal axis of the housings such that the resistance of the housing to loads encountered during operation varies along the longitudinal axis of the housing. For example, a flexible reamer housing can include a tubular central portion and tubular first and second auxiliary portions arranged toward opposite ends of the central portion, the first and second auxiliary portions each having a first stiffness that is less than a second stiffness of the central portion. In this manner, example reamer housings can be configured to maintain a target stiffness of the central portion of the housing in order to protect a tool mechanism located in this portion of the housing, while maintaining sufficient dogleg capability for navigating non-linear boreholes.

FIG. 1 schematically depicts a directional drilling system 100 that is configured to form boreholes at a variety of possible trajectories, including those that deviate from vertical. Directional drilling system 100 may include a land drilling rig 102 to which is attached a drill string 104 and associated bottom hole assembly 106 (hereinafter BHA) in borehole 108. The present disclosure is not limited to land drilling rigs. Examples according to this disclosure may also be employed in drilling systems associated with offshore platforms, semi-submersible, drill ships and any other drilling system satisfactory for forming a borehole extending through one or more downhole formations.

Drilling rig 102 and associated surface control and processing system 118 can be located proximate wellhead 110. Drilling rig 102 can also include a rotary table, rotary drive motor and other equipment associated with rotation of drill string 104 within borehole 108. An annulus 112 will be formed between the exterior of drill string 104 and the formation surfaces defining borehole 108.

Drilling rig 102 will include one or more pumps used to pump drilling fluid 114 (and/or other well servicing fluids) from fluid reservoir 116 to the upper end of drill string 104 at well head 110. A conduit 122 can be used to supply the drilling mud from reservoir 116 to drill string 104. In most operations, annulus 112 will be used to return drilling fluid, formation cuttings and/or downhole debris from the bottom of borehole 108 to fluid reservoir 116. In some cases, another conduit (not shown) can be used to return drilling fluid, formation cuttings and/or downhole debris from the bottom of borehole 108 to fluid reservoir 116. Various types of pipes, tubing and/or other conduits may be used to form conduit 122.

The downhole end of drill string 104 includes BHA 106 including a rotary drill bit 120 disposed adjacent to the end of borehole. Rotary drill bit 120 will include one or more fluid flow passageways with respective nozzles disposed therein. Various types of drilling fluids may be pumped from reservoir 116 to the end of drill string 104 extending from well head 110. The drilling fluid will flow through a longitudinal bore (not expressly shown) of drill string 104 and exit from nozzles formed in rotary drill bit 120.

At the end of borehole 108, drilling fluid may mix with formation cuttings and other downhole debris proximate drill bit 120. The drilling fluid will then flow upwardly through annulus 112 to return formation cuttings and other downhole debris to wellhead 110. A conduit can also be employed to return the drilling fluid to reservoir 116. Various types of screens, filters and/or centrifuges (not expressly shown) may be provided to remove formation cuttings and other downhole debris prior to returning drilling fluid to reservoir 116.

BHA 106 can include various components associated with a measurement while drilling (MWD) system or logging while drilling (LWD) that provides logging data and other information from the bottom of borehole 108 to surface equipment 118. Logging data and other information may be communicated from BHA 106 through drill string 104 using MWD/LWD techniques, including, e.g., mud pulse telemetry, and converted to electrical signals at well head 110 and/or surface equipment 118. Electrical conduit or wires can communicate the electrical signals to surface equipment 118. Logging and other data related to drilling operations can be provided to surface equipment 118 for storage, processing, and/or output. Surface equipment 118 can include a variety of hardware, software, and combinations thereof, including, e.g., one or more programmable processors configured to execute instructions on and retrieve data from and store data on a memory to carry out one or more functions attributed to surface equipment 118 in this disclosure. The processors employed to execute the functions of data processing system 140 may each include one or more processors, such as one or more microprocessors, digital signal processors (DSPs), application specific integrated circuits (ASICs), field programmable gate arrays (FPGAs), programmable logic circuitry, and the like, either alone or in any suitable combination. Various input and output devices, e.g., displays, keyboards, mice, etc., may be provided as part of surface equipment 108.

Drill string 104 includes a number of segments including example reamer 124. Although the following examples are described with reference to a flexible housing for a reamer, examples according to this disclosure are equally applicable to other types of tools. As illustrated in FIG. 1, reamer 124 is configured to flex to navigate bend 126 in deviated borehole 108. In one example, reamer 124 includes a flexible tubular housing that includes different portions with different stiffnesses. For example, the flexible housing of reamer 124 can be fabricated from multiple materials each having a different, respective, stiffness, and/or variable cross-sectional geometry along the longitudinal axis of the housing. Reamer 124 can include a radially expanding and contracting tool mechanism arranged generally in the middle of the tool housing, which includes one or more tool bays including respective apertures that allow the tool mechanism to expand outward into engagement with borehole 108 and collapse inward within the housing. The different stiffness portions of the housing of reamer 124 are distributed among the two ends and central portion of the housing such that the ends are more flexible than the central portion and such that the more flexible ends are configured to bend about the stiffer central portion. Reamer 124 can include a stabilizer or reamer tool, as examples. Different examples of a flexible tool housing that can be employed for reamer 124 or other tools are illustrated and described in more detail with reference to FIGS. 2-6.

Figure 2:
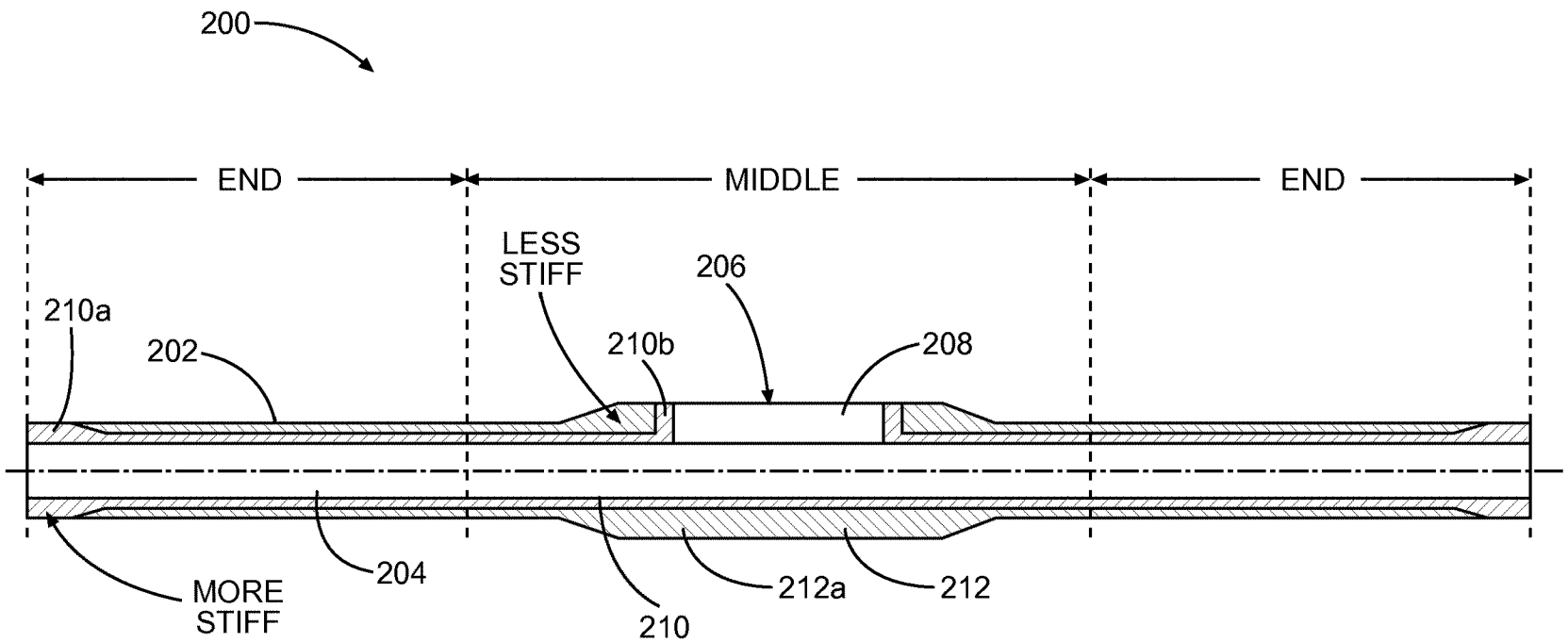
FIG. 2 schematically depicts an example flexible reamer housing in accordance with this disclosure.

FIG. 2 schematically depicts an example flexible reamer housing 200 in accordance with this disclosure. As illustrated in FIG. 2, housing 200 includes a tubular sleeve 202 including a central portion and first and second auxiliary portions arranged toward opposite ends of the central portion, which, in FIG. 2, are labeled as middle and first and second ends, respectively. The demarcations between the ends and middle of tubular sleeve 202 are merely one example shown for illustrative purposes. The relative sizes of such portions of a flexible housing in accordance with this disclosure can differ from the example depicted in FIG. 2. In one example, tubular sleeve 202 is a generally cylindrical sleeve including central bore 204. However, in other examples a tubular sleeve of a flexible housing in accordance with this disclosure can have different cross-sectional shapes, e.g. square or rectangular.

The middle of tubular sleeve 202 includes at least one tool bay 206 with an aperture 208 sized to allow a radially expanding and contracting tool to move radially outward of the outer diameter of sleeve 202. As described above, sleeve 202 may be employed with tools other than reamers. In some examples, the middle of tubular sleeve 202 can include multiple tool bays, e.g., circumferentially arranged around the outer diameter of sleeve 202, for example at 120 degree intervals.

Tubular sleeve 202 is fabricated from multiple materials. Additionally, the cross-sectional geometry of sleeve 202 varies along the longitudinal axis, including a larger diameter in a portion of the middle adjacent tool bay 206. Tubular sleeve 202 includes two concentrically arranged material layers 210 and 212. In the depicted example, layers 210 and 212 can be concentrically arranged layers of different materials. Layers 210 and 212 are fabricated from different materials. Layer 210 is fabricated from a first material with a higher stiffness than the second material from which layer 212 is fabricated. Stiffness can be measured or achieved in a variety of ways. In one example, layer 210 is fabricated from a first material with higher Young's modulus (sometimes referred to as modulus of elasticity) than the Young's modulus of the second material from which layer 212 is fabricated.

Layer 212 is arranged radially outward from layer 210 and central bore 204 for almost the entire length of sleeve 202. Layers 210 and 212 both extend generally across the two ends and middle of tubular sleeve 202. Layer 210 extends across the entire length of tubular sleeve 202 including across the two ends and middle. Layer 210 is arranged radially inward of layer 212, except toward the terminal portions of the two ends which include thicker sections 210*a* of layer 210 and no layer 212. Layer 210 also includes a radially outward extending section 210*b*, which lines the periphery of tool bay 206. Layer 212 extends across almost the entire length of tubular sleeve 202, except at the terminal portions of the two ends including thicker sections 210*a* of layer 210. Additionally, layer 212 includes a thicker section 212*a* in the middle of tubular sleeve adjacent tool bay 206.

The functional effect of the relative size, arrangement, and stiffness of layers 210 and 212 of tubular sleeve 202, and the longitudinally varying cross-sectional geometry of sleeve 202 is to make the ends of sleeve 202 more flexible than the middle such that the more flexible ends are configured to bend about the stiffer middle. With such a configuration, tubular sleeve 202 can be configured to provide a satisfactory dogleg capability to navigate deviated boreholes, while simultaneously retaining enough strength and stiffness in the middle to protect the tool accommodated by tool bay 206.

The particular materials and associated properties of layers 210 and 212, as well as the cross-sectional profile variance can be selected depending on the intended application of tubular sleeve 202. For example, the stiffer layer 210 can be fabricated from a steel or various steel alloys, while the less stiff layer 212 can be fabricated from aluminum, copper, titanium, bronze, brass, and combinations thereof. Additionally, the diameter of portions of the middle of sleeve 202 can be increased to increase stiffness and the diameter of portions of the ends of sleeve 202 can be decreased to decrease stiffness.

Figure 3:
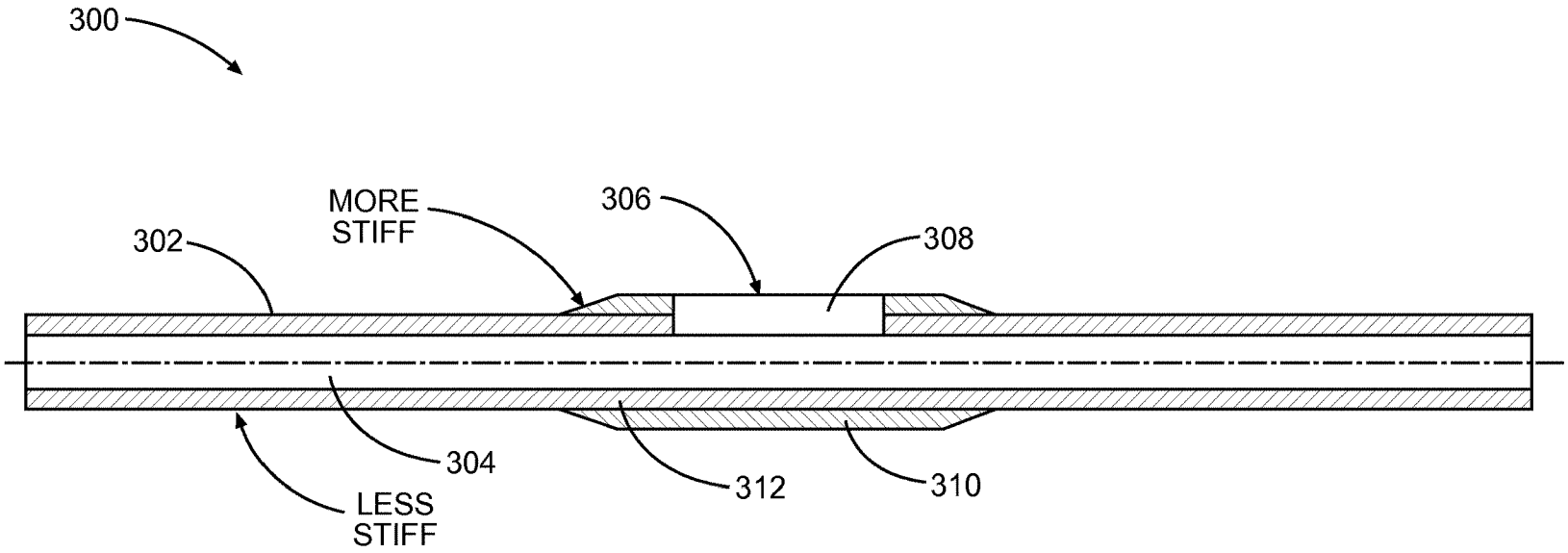
FIG. 3 schematically depicts another example flexible tool housing in accordance with this disclosure.
Figure 4A:
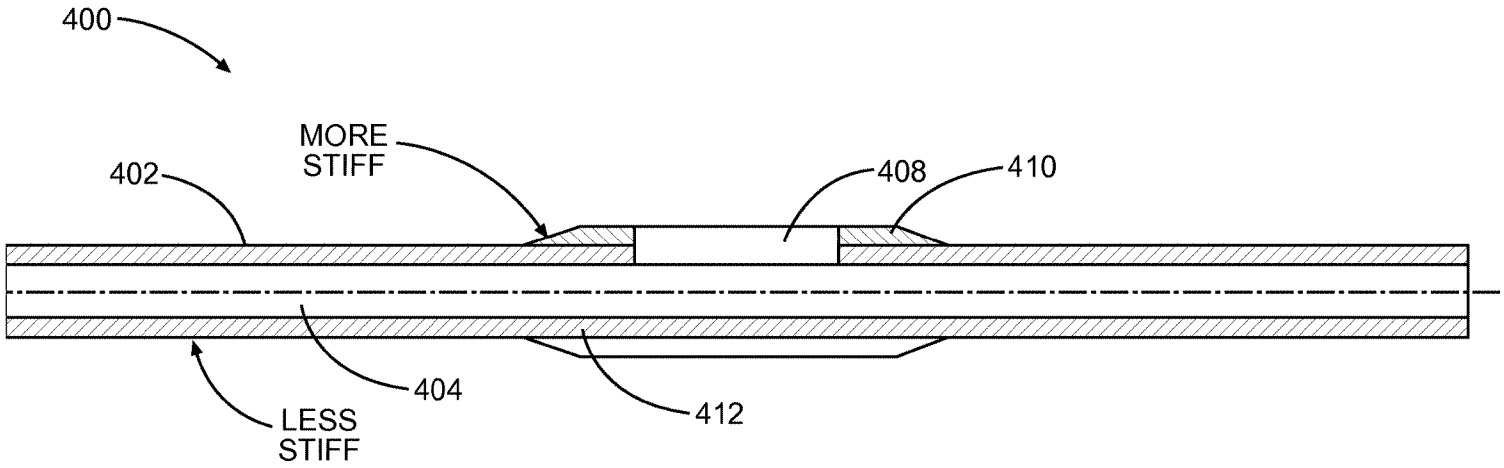
FIGS. 4A and 4B schematically depict another example drilling tool housing in accordance with this disclosure.
Figure 4B:
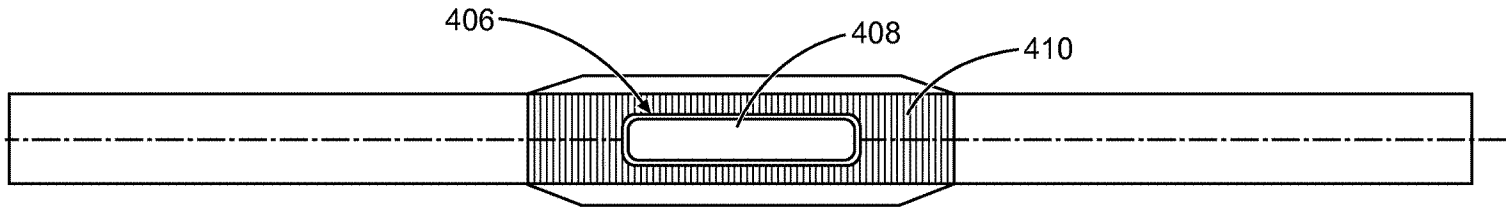
Figure 5:
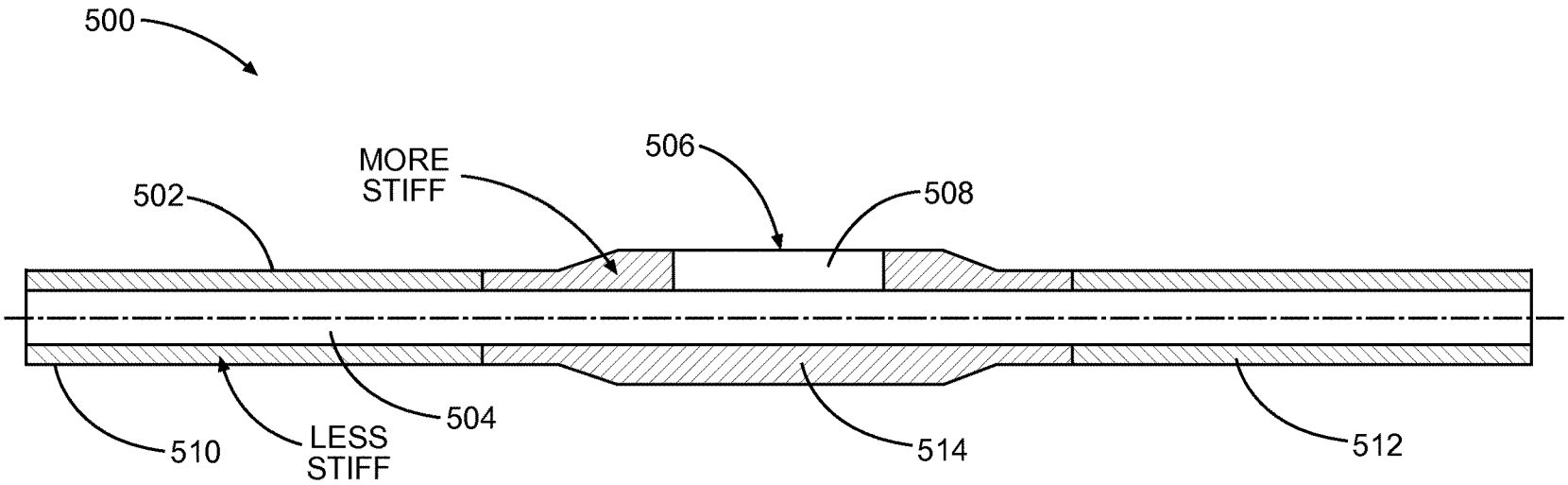
FIG. 5 schematically depicts another example flexible tool housing in accordance with this disclosure.

FIGS. 3-5 schematically depict a number of additional example flexible tool housings in accordance with this disclosure. The arrangement, size, number, shape, etc. of the different materials of the tubular sleeves of these examples vary and are described below. However, the foregoing description of varying stiffness, varying geometry, possible materials, and the effect of such variations on the function of example housing 200 of FIG. 2 is also applicable to the example housings of FIGS. 3-5.

FIG. 3 schematically depicts another example flexible tool housing 300 in accordance with this disclosure. As illustrated in FIG. 3, housing 300 includes a tubular sleeve 302 including a central portion and first and second auxiliary portions arranged toward opposite ends of the central portion (not specifically demarcated in this example), which are referred to below as the middle and ends of sleeve 302, respectively. In one example, tubular sleeve 302 is a generally cylindrical sleeve including central bore 304.

The middle of tubular sleeve 302 includes at least one tool bay 306 with aperture 308 sized to allow a radially expanding and contracting tool to move radially outward of the outer diameter of sleeve 302. In some examples, the middle of tubular sleeve 302 can include multiple tool bays, e.g., circumferentially arranged around the outer diameter of sleeve 302.

Tubular sleeve 302 is fabricated from multiple materials. Additionally, the cross-sectional geometry of sleeve 302 varies along the longitudinal axis, including a larger diameter in a portion of the middle adjacent tool bay 306. Tubular sleeve 302 includes two radially arranged layers 310 and 312. In one example, layers 310 and 312 can be concentrically arranged layers of different materials. Layers 310 and 312 are fabricated from different materials. Layer 310 is fabricated from a first material with a higher stiffness than the second material from which layer 312 is fabricated.

Layer 310 is arranged radially outward from layer 312 and central bore 304 for a portion of the length of sleeve 302. Layer 312 extends across the entire length of tubular sleeve 302 including across the two ends and middle. Layer 310, on the other hand, extends only across at least a portion of the middle of sleeve 302 adjacent tool bay 306. In this configuration, the ends and part of the middle of sleeve 302 includes only the less stiff layer 312 and a portion of the middle adjacent tool bay 306 includes both layer 312 and the stiffer layer 310. In the example of FIG. 3, stiffer layer 312 can extend circumferentially around substantially the entire outer diameter of the middle of sleeve 302.

FIGS. 4A and 4B schematically depict another example flexible tool housing 400 in accordance with this disclosure. Housing 400 includes a tubular sleeve 402 with two ends and a middle (not specifically demarcated in this example). In one example, tubular sleeve 402 is a generally cylindrical sleeve including central bore 404.

The middle of tubular sleeve 402 includes at least one tool bay 406 with aperture 408 sized to allow a radially expanding and contracting tool to move radially outward of the outer diameter of sleeve 402. In some examples, the middle of tubular sleeve 402 can include multiple tool bays, e.g., circumferentially arranged around the outer diameter of sleeve 402.

Example sleeve 402 is substantially the same as sleeve 302 of FIG. 3, with two radially arranged layers 410 and 412 with the stiffer material layer 410 arranged radially outward of the less stiff material layer 412 and layer 410 extending axially only across a portion of the middle of sleeve 402 adjacent tool bay 406. In the example of sleeve 402, however, stiffer layer 410 extends circumferentially around only a portion of the outer diameter of sleeve 402 adjacent tool bay 406. In examples including multiple tool bays, sleeve 402 could include multiple circumferentially distributed sections of stiffer layer 410 aligned with the multiple tool bays. These sections of additional layer 410 could therefore form a number of discrete sections of increased overall material thickness/tool outer diameter, which protrude radially outward from the inner layer 412.

FIG. 5 schematically depicts another example flexible tool housing 500 in accordance with this disclosure. As illustrated in FIG. 5, housing 500 includes a tubular sleeve 502 including two ends and a middle. In one example, tubular sleeve 502 is a generally cylindrical sleeve including central bore 504.

The middle of tubular sleeve 502 includes at least one tool bay 506 with aperture 508 sized to allow a radially expanding and contracting tool to move radially outward of the outer diameter of sleeve 502. In some examples, the middle of tubular sleeve 502 can include multiple tool bays, e.g., circumferentially arranged around the outer diameter of sleeve 502.

Tubular sleeve 502 is fabricated from multiple materials. In particular, tubular sleeve 502 includes first and second end material portions 510 and 512 and a middle material portion 514 there between. Middle material portion 514 is fabricated from a stiffer material than the material or materials from which end material portions 510 and 512 are fabricated. Additionally, in the example of FIG. 5, a portion of middle material portion 514 includes a larger outer diameter than end material portions 510 and 512.

Although not specifically illustrated, all of the foregoing example flexible tool housings can include cavities, electrical, mechanical, and/or hydraulic components, or other features adapted for the mechanism of the radially expanding and contracting tool mechanisms that are adapted to move in and out through the described tool bay(s) of the housings. For example, example flexible tool housings in accordance with this disclosure can be adapted to house a linkage mechanism and associated actuation system for moving reamer arms from within the housing radially outward into engagement with a portion of the borehole within which the tool housing is suspended.

Example flexible tool housings in accordance with this disclosure can be used to form non-linear boreholes, including, for example, boreholes with a vertical section and a section that deviates from vertical. In one example, a subterranean drilling tool string including a drill bit arranged at the downhole end of the tool string is employed to drill a non-linear subterranean borehole. The tool string includes at least one flexible tool housing that is configured to navigate portions of the borehole that deviate from a substantially straight, linear path. The flexible tool housing includes a tubular central portion including a tool bay with an aperture to allow a reamer cutter arm within the tool bay to move radially outward through the aperture. The housing also includes tubular first and second auxiliary portions arranged toward opposite ends of the central portion. The first and second auxiliary portions each include a first stiffness that is less than a second stiffness of the central portion. Such example tool housings can therefore be configured to maintain a target stiffness of the central portion of the tool housing in order to protect a tool mechanism located in this portion of the housing, while maintaining sufficient dogleg capability for drilling deviated boreholes.

Various examples have been described. These and other examples are within the scope of the following claims.

What is claimed is:

1. A flexible reamer housing comprising:

a tubular central portion comprising a tool bay with an aperture to allow a reamer cutter arm within the tool bay to move radially outward through the aperture, and the tubular central portion includes a housing comprising a first material with a first material stiffness; and tubular first and second auxiliary portions arranged toward opposite ends of the central portion, the first and second auxiliary portions each comprising a second material with a second material stiffness, and the first material stiffness is greater than the second material stiffness.

2. The flexible reamer housing of claim 1, wherein the central portion and the first and second auxiliary portions together define a tubular sleeve having a lower bending stiffness along the first and second auxiliary portions than along the central portion under an applied bending moment.

3. The reamer housing of claim 1, wherein the central portion comprises a first outer diameter and the first and second auxiliary portions comprise a second outer diameter, which is less than the first outer diameter.

4. The reamer housing of claim 1, comprising:

a plurality of concentrically arranged material layers, each comprising one of the first or second materials.

5. The reamer housing of claim 4, wherein the plurality of concentrically arranged layers comprises:

a first material layer comprising the first material with the first material stiffness; and a second material layer comprising the second material with the second material stiffness, which is less than the first material stiffness.

6. The reamer housing of claim 5, wherein the first material layer is arranged radially outward of the second material layer.

7. The reamer housing of claim 6, wherein the first material layer extends axially across the central portion and the second material layer extends axially across the central portion and the first and second auxiliary portions.

8. The reamer housing of claim 7, wherein the first material layer extends circumferentially across the entire circumference of the central portion.

9. The reamer housing of claim 4, wherein the first material layer is arranged radially inward of the second material layer.

10. The reamer housing of claim 1, wherein the first and second auxiliary portions are integral with the central portion to form a single tubular sleeve.

11. The reamer housing of claim 1, wherein the first and second auxiliary portions are separate from and joined to the central portion.

12. The reamer housing of claim 1, wherein the central portion comprises a plurality of tool bays comprising a plurality of respective apertures, the plurality of tool bays circumferentially distributed about the outer diameter of the housing.

13. A system comprising:

a tool string configured to be disposed in a borehole and coupled at the surface to a drilling rig, wherein the tool string comprises at least one flexible tool housing comprising:

a tubular central portion comprising a tool bay with an aperture to allow a reamer cutter arm within the tool bay to move radially outward through the aperture, and the tubular central portion includes a housing comprising a first material with a first material stiffness; and tubular first and second auxiliary portions arranged toward opposite ends of the central portion, the first and second auxiliary portions each comprising a second material with a second material stiffness, and the first material stiffness is greater than the second material stiffness.

14. The system of claim 13, wherein the central portion and the first and second auxiliary portions together define a tubular sleeve having a lower bending stiffness along the first and second auxiliary portions than along the central portion under an applied bending moment.

15. The system claim 13, wherein the central portion comprises a first outer diameter and the first and second auxiliary portions comprise a second outer diameter, which is less than the first outer diameter.

16. The system claim 13, wherein the first and second materials are disposed in a plurality of concentrically arranged material layers, each material layer consisting essentially of a respective one of the first or second materials.

17. The system claim 16, wherein the plurality of concentrically arranged material layers comprises:

a first material layer comprising the first material with the first material stiffness; and a second material layer comprising the second material with the second material stiffness, which is less than the first material stiffness.

18. The system claim 17, wherein the first material layer is arranged radially outward of the second material layer.

19. The system claim 18, wherein the first material layer extends axially across the central portion and the second material layer extends axially across the central portion and the first and second auxiliary portions.

20. The system claim 19, wherein the first material layer extends circumferentially across the entire circumference of the central portion.

21. The system claim 16, wherein the first material layer is arranged radially inward of the second layer.

22. The system claim 13, wherein the first and second auxiliary portions are integral with the central portion to form a single tubular sleeve.

23. The system claim 13, wherein the first and second auxiliary portions are separate from and joined to the central portion.

24. The system claim 13, wherein the central portion comprises a plurality of tool bays comprising a plurality of respective apertures, the plurality of tool bays circumferentially distributed about the outer diameter of the housing.

25. A flexible reamer housing comprising:

a first tubular portion comprising a tool bay with an aperture to allow a reamer cutter arm within the tool bay to move radially outward through the aperture, and the first tubular portion includes a housing comprising a first material with a first material stiffness; and a second tubular portion coupled to the first tubular portion, the second tubular portion comprising a second material with a second material stiffness, and the first material stiffness is greater than the second material stiffness.

* * * * *